US007435208B2

(12) United States Patent
Garthaffner

(10) Patent No.: US 7,435,208 B2
(45) Date of Patent: Oct. 14, 2008

(54) DEGRADABLE SLITTED CIGARETTE FILTER

(75) Inventor: Martin T. Garthaffner, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 315 days.

(21) Appl. No.: 10/387,111

(22) Filed: Mar. 12, 2003

(65) Prior Publication Data

US 2004/0177855 A1 Sep. 16, 2004

Related U.S. Application Data

(62) Division of application No. 10/346,313, filed on Jan. 17, 2003, now abandoned.

(51) Int. Cl.
*B31C 13/00* (2006.01)

(52) U.S. Cl. ..... 493/39; 493/45

(58) Field of Classification Search ..... 493/39, 493/45, 50; 131/336, 338, 341
See application file for complete search history.

(56) References Cited

U.S. PATENT DOCUMENTS 3,081,778 A * 3/1963 Dearsley ..... 131/94
3,164,243 A * 1/1965 Schubert et al. ..... 198/450
3,800,676 A * 4/1974 Levers et al. ..... 493/44
4,090,424 A * 5/1978 Hall ..... 83/330
4,149,546 A * 4/1979 Luke et al. ..... 131/94
4,219,030 A 8/1980 Hall
4,232,574 A 11/1980 Hall
4,273,141 A * 6/1981 Jan Van Tilburg ..... 131/336
4,532,943 A 8/1985 Nichols et al.
4,570,649 A 2/1986 Nichols et al.
4,600,027 A 7/1986 Houck et al.
4,646,763 A 3/1987 Nichols
4,687,009 A 8/1987 Nichols
4,869,276 A * 9/1989 Sprinkel, Jr. ..... 131/361
5,947,126 A 9/1999 Wilson et al.
6,701,934 B2 * 3/2004 Schlisio et al. ..... 131/94

* cited by examiner

*Primary Examiner*—Sameh H. Tawfik
*Assistant Examiner*—Rinaldi Rada
(74) *Attorney, Agent, or Firm*—Connolly Bove Lodge & Hutz LLP

(57) ABSTRACT

A cigarette filter comprises an elongate filter component having a longitudinal axis. A plurality of spaced apart slits generally perpendicular to the longitudinal axis of the filter component partially extend into the component. The slits enable the filter to disintegrate and more readily degrade after being used and discarded. Processes and apparatus are provided for producing such cigarette filters.

9 Claims, 2 Drawing Sheets

DEGRADABLE SLITTED CIGARETTE FILTER

CROSS-REFERENCE TO RELATED APPLICATION

The present application is a division of application Ser. No. 10/346,313, filed Jan. 17, 2003 now abandoned.

BACKGROUND OF THE INVENTION

The present invention relates to cigarette filters with slits therein that enable the filter to disintegrate and more readily degrade after use, and more particularly to such filters as well as processes and apparatus for slitting filters to accelerate degradation of the filters after being used and discarded.

Cellulose acetate is commonly used in the production of cigarette filters. This material is often used alone or in combination with a variety of other substances. Often the overall mass of the cellulose acetate filter component makes it difficult to degrade except over long periods of time. While smaller cellulose acetate pieces would accelerate the degradation process little if any effort is made by the end user to break the filter component apart after the cigarette is smoked.

SUMMARY OF THE INVENTION

Accordingly, one of the objects of the present invention is a cigarette filter with slits therein which functions in a highly efficient manner to accelerate degradation of the filter after being used and discarded.

Another object of the present invention is a process for slitting cigarette filters prior to being combined with tobacco rods in the manufacture of cigarettes, such process being relatively simple, yet highly effective in slitting the filter to thereby make the filter significantly more degradable when compared to a similar filter without slits.

Still another object of the present invention is an apparatus for slitting cigarette filters which is simple to use yet highly effective in slitting filters to render them degradable after being used and discarded.

In accordance with the present invention, a cigarette filter comprises an elongate component having a longitudinal axis. A plurality of spaced apart slits generally perpendicular to the longitudinal axis of the elongate component partially extend into the component to thereby make the filter significantly more degradable when compared to a filter without such slits. The slits enable the cigarette filter to be broken apart more readily and thereby accelerate the degradation process.

Preferably the elongate component has a cylindrical shape and primarily comprises a cellulose acetate tow. Moreover, the plurality of spaced apart slits partially extend into the elongate component of the filter approximately midway through the component.

Additionally, the plurality of slits may include first and second groups of equally spaced apart slits parallel to one another, and the first and second groups may be approximately 180° apart from each other on opposite sides of the elongate component. Moreover, the slits of the first group may be staggered with respect to the slits of the second group so that each slit of the first group is located between two slits of the second group and vice versa.

The present invention also includes a process for producing cigarette filters with slits therein that function to accelerate degradation of the filter after being used and discarded. Fundamentally, the process comprises the steps of providing a supply of elongated filter rods, each having a longitudinal axis. Preferably the filter rods have a cylindrical configuration and the rods comprise cellulose acetate tow. The filter rods are transported along a path of travel past at least one slitter mechanism having spaced apart cutter blades that partially enter the filter rods in a direction perpendicular to the longitudinal axis of the rods. The filter rods are partially slitted with the blades of the slitter mechanism. Subsequently, the slitted filter rod is cut into individual cigarette filter lengths and the filters are combined with tobacco rods by wrapping each filter and its associated tobacco rod with tipping paper.

The process step of slitting the filter rods may include a pair of slitter mechanisms each having a plurality of spaced apart rotating cutter blades that partially enter the filter rods to produce the slits therein. In a preferred embodiment of the present invention, the blades of one slitter mechanism are spaced approximately 180° apart from the blades of the other mechanism whereby each cigarette filter has a first row of slits on one side of the filter and a second row of slits on the opposite side of the filter. Moreover, the first row of slits may be staggered with respect to the second row of slits on the opposite side of the cigarette filter.

The present invention further includes an apparatus for producing cigarette filters with slits therein to accelerate degradation of the filter after being used and discarded. Basically, the apparatus comprises a supply of elongate filter rods, each having a longitudinal axis. Preferably the filter rods are cylindrical in configuration and comprise cellulose acetate tow. A transport system conveys the filter rods from the supply along a predetermined path of travel. At least one slitter mechanisms is positioned adjacent the path of travel of the filter rods, and such slitter mechanism includes a plurality of spaced apart rotating cutter blades constructed and arranged to partially enter and thereby slit the filter rods in a direction perpendicular to the longitudinal axis of the elongate filter rods. Subsequently a cutter is provided for separating the filter rods into smaller cigarette filter components.

Preferably the apparatus includes a pair of slitter mechanisms with a first set of spaced apart cutter blades associated with one slitter mechanism and a second set of spaced apart cutter blades associated with the other slitter mechanism. The first set of blades is constructed and arranged to partially enter the filter rods at a first location on the rods while the second set of cutter blades is constructed and arranged to enter the filter rods at a second location approximately opposite the first location. The arrangement of the cutter blades of the first set is such that these blades are longitudinal offset and staggered with respect to the blades of the second set.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
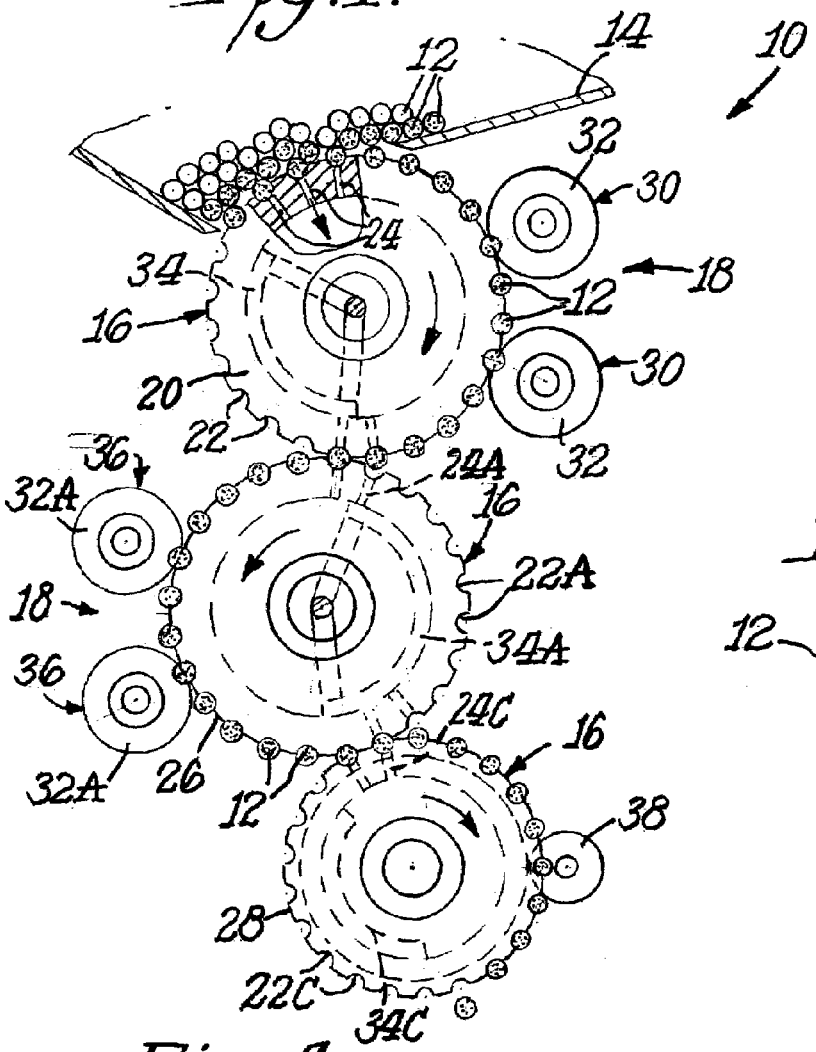
FIG. 1 is a schematic front elevational view of a machine for slitting cigarette filter rods in order to accelerate degradation of individual cigarette filters after being used and discarded.

Referring in more particularity to the drawings, FIG. 1 illustrates a machine 10 for slitting cigarette filter rods 12 in order to accelerate degradation of individual cigarette filters after being used and discarded. Basically, machine 10 comprises a supply of elongate filter rods 12 in the form of a hopper 14. A transport system 16 comprising several vacuum drums functions to convey the filter rods along a predetermined path of travel. Slitter mechanisms 18 are positioned adjacent the path of travel of the filter rods to partially slit the rods, as explained more fully below.

The transport system 16 includes a first vacuum drum 20 with peripherally disposed grooves 22 that extend across the width of the drum. A vacuum within the drum is connected to the peripheral grooves 22 by passageways 24. Accordingly, as the first vacuum drum 20 is rotated in a clockwise direction, individual filter rods 12 from hopper 14 are drawn into the peripheral grooves 22 by the vacuum within the drum. The transport system 16 also includes a second vacuum drum 26 and a third vacuum drum 28, as explained more fully below.

Figure 2:
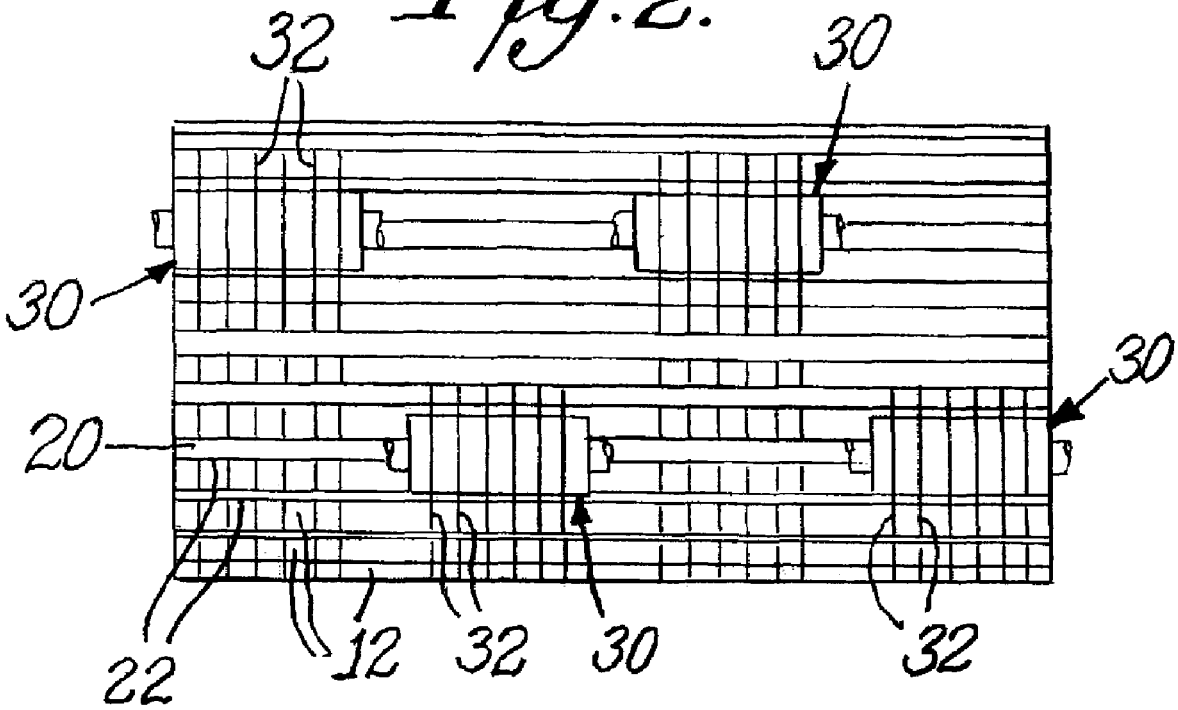
FIG. 2 is a fragmental side elevational view of the filter slitting blades of the machine of FIG. 1 illustrating the arrangement of the blades relative to the cigarette filter rods.

The slitter mechanism 18 includes a first group of multiple cutters adjacent the first vacuum drum 20. This group includes four slitters 30 each comprising a plurality of rotating cutter blades 32 that partially enter and slit the filter rods 12 in a direction approximately perpendicular to the longitudinal axis of the filter rods. As best shown in FIG. 2, the slitters 30 are arranged to partially cut into the filter rods at four locations along the length of the rods. Each location ultimately becomes an individual filter length, and in the examples shown in the drawings, each rod produces four individual cigarette filters.

After the slitters 30 partially cut into the filter rods 12, continued rotation of the first vacuum drum 20 transports the filter rods to the nip between the first and second vacuum drums. The vacuum holding the filter rods in the grooves 22 is terminated and the filter rods are transferred to the grooves 22A of the second vacuum drum 26. Vacuum within the first drum 20 is terminated at the transfer point by a stationary piece 34 within the first vacuum drum that seals off the passageways 24 between the transfer point and the point at which filter rods are deposited in the grooves at the hopper 14.

The second vacuum drum is similar in construction to the first vacuum drum. A second bank of slitters 36 is provided adjacent the second vacuum drum and this arrangement of slitters is similar to the arrangement shown in FIG. 2. Rotating cutting blades 32A of the slitters 36 partially cut into the filter rods in the same manner as the slitters 30. The only difference is that the filter rods are slit at a location opposite the location where the slitters 30 cut into the rod. With this arrangement the filter rods are partially slit on one side thereof by the slitters 30 adjacent drum 20 and then on the opposite side approximately 180° apart by the slitters 36 adjacent the drum 26.

The filter rods 12 are transferred to the third vacuum drum 28 where a cutter 38 operates to cut the filter rods into desired lengths. Transfer between the second and third vacuum drums is accomplished by terminating the vacuum applied to the grooves 22A of the second vacuum drum 26 by the internal stationary piece 34A which blocks the passageways 24A at the point of transfer. The third vacuum drum also includes a similar piece 34C internally located at the point of release of the cut filters from the grooves 22C of the third vacuum drum.

Figure 3:
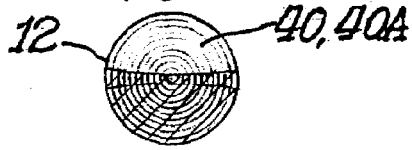
FIG. 3 is cross-sectional view taken through one of the slits in the cigarette filter rod.

The elongate filter rod 12 preferably has a cylindrical configuration with a longitudinal axis extending the length of the rod. Moreover, the filter rod may comprise cellulose acetate tow, but other materials are equally applicable. In many instances the fibers of the cellulose acetate tow are long and longitudinally oriented. The rotating blades 32, 32A of the slitters 30, 36 provide slits 40, 40A in the filter rods and these slits are generally perpendicular to the longitudinal axis of the filter rods. The slits function to shorten the otherwise long cellulose acetate fibers which accelerates the degradation process. Each slit partially extends into the elongate component of the filter approximately midway therethrough, as shown best in FIG. 3.

Figure 4:
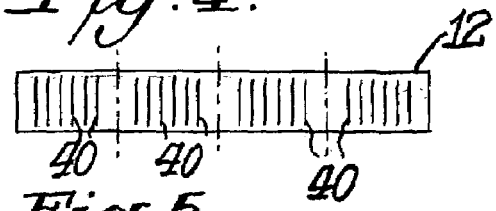
FIG. 4 is a side elevational view of a cigarette filter rod with multiple slits therein.
Figure 5:
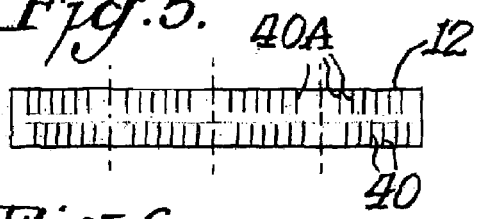
FIG. 5 is a top plan view of the cigarette filter rod shown in FIG. 4 illustrating the multiple slits therein with the slits on opposite sides of the filter rod in staggered relationship with one another.

FIG. 4 is a right or left side elevational view of the filter rod 12 with multiple slits 40, 40A therein. For example, the rotating blades 32 of the slitters 30 produce the slits 40 on the right side of the filter rod while the rotating blades 32A of the slitters 36 produce the multiple slits 40A on the left side of the filter rod. As shown best in FIG. 5, the slits on one side of the filter rod are longitudinally offset with respect to the slits on the opposite side of the filter rod. This produces the staggered pattern shown in FIG. 5 where each of the slits on one side is midway between adjacent slits on the opposite side. This pattern is produced by a longitudinal offset between the rotating blades 32 of the slitters 30 and the rotating blades 32A of the slitters 36.

Figure 6:
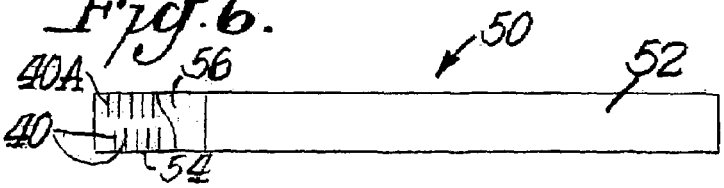
FIG. 6 is a diagrammatic view of a cigarette comprising a tobacco rod and an individual filter component made from the elongate filter rod of FIGS. 4 and 5.

FIG. 6 shows a cigarette 50 comprising a tobacco rod 52 and an individual filter 54 cut from the filter rod 12 after the filter slitting operation. The filter 54 is attached to the tobacco rod with tipping paper 56.

Slitting the cigarette filter as described above functions to accelerate degradation of the filter after being used and discarded. Normally the mass of a cellulose acetate filter together with the length and longitudinal orientation of the cellulose acetate fibers make it difficult to degrade except over long periods of time. However, with the cigarette filter of the present invention the filter easily disintegrates after use thereby accelerating the degradation process.

It should be understood that the above detailed description while indicating preferred embodiments of the invention are given by way of illustration only since various changes and modifications within the spirit and scope of the invention will become apparent to those skilled in the art from the detailed description. For example, the slits 40, 40A may be positioned on the filter at a separation of less than 180°. Also, the depth of the slits may be varied by moving the slitter mechanisms 18 toward or away from the transport system 16. With the staggered slit arrangement, the depth of the individual slits may be more than half way through the filter, if desired.

What is claimed is:

1. A process for producing cigarette filters with slits therein to accelerate degradation of the cigarette filter after being used and discarded, the process comprising the steps of:

providing a supply of elongate filter rods, each filter rod having a length and a longitudinal axis;

transporting the elongate filter rods along a path of travel past at least one slitter mechanism comprising spaced apart parallel cutter blades having a common axis of rotation substantially parallel to the longitudinal axis of the filler rods so that the parallel cutter blades simultaneously partially enter the filter rods in a direction perpendicular to the longitudinal axis of the rods;

simultaneously partially slitting the filter rods with the parallel cutter blades of the slitter mechanism to thereby form parallel slits along the length of the filter rod to accelerate degradation of the cigarette filter after being used and discarded; and cutting the slitted filter rod into smaller lengths.

2. A process for producing cigarette filters as in claim 1 wherein the elongate filter rods are cylindrical and comprise cellulose acetate tow.

3. A process for producing cigarette as in claim 1 wherein the blades of the first slitter mechanism are longitudinally offset and staggered with respect to the blades of the second slitter mechanism.

4. A process for producing cigarette filters as in claim 3 including the step of varying the depth of slits.

5. A process for producing cigarette filters as in claim 1 including the step of separating the axis of rotation of the blades of the first slitter mechanism 180° from the axis of rotation of the blades of the second slitter mechanism.

6. A process for producing cigarette filters as in claim 1 including the step of separating the axis of rotation of the blades of the first slitter mechanism less than 180° from the axis of rotation of the blades of the second slitter mechanism.

7. A process for producing cigarette filters as in claim 1 including the step of varying the depth of slits.

8. A process for producing cigarette filters as in claim 1 including the step of varying the depth of slits.

9. A process for producing cigarette filters as in claim 1 wherein the parallel slits generally extend from one end of the filter rod to the other.

* * * * *